US012150496B2

(12) United States Patent
Zarabi

(10) Patent No.: US 12,150,496 B2
(45) Date of Patent: Nov. 26, 2024

(54) MOISTURE TRAPPING BRA

(71) Applicant: Robert K. Zarabi, Chatsworth, CA (US)

(72) Inventor: Robert K. Zarabi, Chatsworth, CA (US)

( * ) Notice: Subject to any disclaimer, the term of this patent is extended or adjusted under 35 U.S.C. 154(b) by 57 days.

(21) Appl. No.: 17/988,995

(22) Filed: Nov. 17, 2022

(65) Prior Publication Data

US 2024/0164455 A1 May 23, 2024

(51) Int. Cl.
*A41C 3/00* (2006.01)

(52) U.S. Cl.
CPC ..... *A41C 3/0021* (2013.01); *A41C 3/0014* (2013.01)

(58) Field of Classification Search
CPC ..... A41C 3/0014; A41C 3/0021
USPC ..... 450/57, 60, 61
See application file for complete search history.

(56) References Cited

U.S. PATENT DOCUMENTS 1,026,326 A * 5/1912 Leporin ..... A41C 3/10 450/56
2,104,725 A * 1/1938 Boris ..... A41C 3/10 450/53
5,603,653 A * 2/1997 Hartman ..... A41B 9/12 450/56
5,716,255 A 2/1998 Abercrombie et al.
6,176,761 B1 * 1/2001 Underhill ..... A41C 3/0014 450/1
6,341,377 B1 * 1/2002 Faries, Jr. ..... A41D 27/13 420/57
6,406,353 B1 * 6/2002 Harper ..... A41C 3/12 450/1
6,431,945 B1 * 8/2002 Stephens ..... A41C 3/10 450/37
7,442,110 B2 * 10/2008 Gaudet ..... A41C 3/144 450/39
7,806,748 B2 * 10/2010 Richardson ..... A41C 3/02 450/86
7,905,763 B1 * 3/2011 Frank ..... A61F 13/141 450/37
8,075,367 B2 * 12/2011 Taylor ..... A41C 3/10 2/57
8,898,812 B2 * 12/2014 Thompson ..... A41D 27/13 2/53
9,961,946 B2 * 5/2018 Calhoun ..... A41C 3/144
10,327,480 B2 * 6/2019 Khan ..... A61F 13/47
(Continued)

OTHER PUBLICATIONS

Great Britain Search Report, Apr. 15, 2024, Appl. No. GB2315758.9.

*Primary Examiner* — Jocelyn Bravo
(74) *Attorney, Agent, or Firm* — Howard M. Gitten, Esq.; Lewis Brisbois Bisgaard & Smith LLP

(57) ABSTRACT

A bra includes at least one cup. A sling is disposed adjacent the cup. The sling is disposed adjacent the cup in facing relation with a user of the bra. The sling includes a first layer deposed to be in contact with the skin of the user when the bra is worn; the first layer wicking moisture away from the skin of the user. A second layer of the wicking member is disposed on a surface of the first layer away from the skin contacting surface of the first layer. The second layer trapping moisture received from the first layer. A third layer is disposed on a surface of the second a layer which is away from the first layer and is a moisture barrier, preventing moisture from travelling therethrough.

4 Claims, 4 Drawing Sheets

(56) References Cited

U.S. PATENT DOCUMENTS

| | | | | |
|---|---|---|---|---|
| 10,786,016 | B2 * | 9/2020 | Caden | A61F 13/14 |
| 11,406,141 | B2 * | 8/2022 | Lucas Gaus | A41C 3/0035 |
| 2004/0226069 | A1 | 11/2004 | Reeves | |
| 2005/0136797 | A1 * | 6/2005 | Mitchell | A41C 5/00 450/60 |
| 2005/0164602 | A1 * | 7/2005 | Armstrong | A41C 3/0057 450/57 |
| 2008/0261489 | A1 * | 10/2008 | Sweeney | A41C 3/0057 450/39 |
| 2010/0022164 | A1 * | 1/2010 | Taylor | A41C 3/10 604/360 |
| 2010/0065065 | A1 * | 3/2010 | Johnston | A61F 13/141 128/845 |
| 2012/0192333 | A1 * | 8/2012 | Thompson | A41D 27/13 2/69 |
| 2013/0052914 | A1 | 2/2013 | Neng | |
| 2018/0317571 | A1 * | 11/2018 | Caden | A41C 3/0057 |
| 2021/0052020 | A1 * | 2/2021 | Snyder | A41C 3/122 |
| 2022/0346465 | A1 * | 11/2022 | Stewart | A41C 3/02 |
| 2023/0091122 | A1 * | 3/2023 | Harrison | A41D 27/133 450/57 |
| 2023/0218015 | A1 * | 7/2023 | Wong | A41C 3/0028 450/57 |

* cited by examiner

MOISTURE TRAPPING BRA

FIELD OF THE INVENTION

The present invention relates to a bra, and more particularly to a moisture wicking bra that utilizes a multi layered sling construction to capture, absorb and lock moisture away from the user's body.

BACKGROUND

A wide range of bras, as known in the art, have been produced for general use, typically with a focus on function related to support, comfort, and aesthetics in relation to breast form. However, the prior art bra lacks the ability of the bra to keep the average user free of moisture getting captured within the garment and on to the user's body. These general use bras have been produced for general use and are typically aimed at providing a basic way to keep the individuals breasts in place and presented in a way that meets the user's aesthetic expectations.

While the prior art bra is adequate for general use, the constraining structures of these garments creates an unfortunate side effect where the skin that is kept in place by the bra also can generate a significant amount of perspiration due to basic anatomy of breast skin folds and/or the constriction of both the bra and the garment being worn over it. The heat that is generated in this scenario can regularly result in the individual perspiring from the constriction with the moisture left nowhere to go but onto the individual's skin and possibly onto their outward garments. This creates both an uncomfortable situation for the individual wearing the garment but could also cause unsightly spots on the garments that they wear; resulting in embarrassment.

With a traditional fabric bra, the design of the cup and the supporting material that keeps it in place have been created with a sole focus of keeping the breast supported and in a position using a flexible boundary in the form of a flexible fabric cup. For individuals who wear these bras and suffer from a significant amount of perspiration, the alternative to this moisture seeping out or staying on the body is to apply some form of cloth or paper material under the bottom of the bra in order to capture the perspiration and keep it away from the individual and the garment they are wearing.

This solution to the perspiration issue, while generally functional for a short period of time, can suffers from several disadvantages including the paper or material falling apart or getting overly wet to the point that it no longer serves the purpose; bleeding through the bra. These attempts to correct for this perspiration challenge are inconvenient and ineffective and create a difficulty for individuals to maintain over extended periods of time.

Another approach is to incorporate moisture wicking materials in the bra. A number of materials available on the market that attempt to address small part of this challenge in the form of moisture wicking designed materials. These materials can be found on many garments and also on certain bras today. While moisture wicking materials are a helpful tool in attempting to capture perspiration into the garment, they lack the absorption needed in order to continuously capture moisture and keep it away from the wearer of the bra and from transference to the person's clothes.

By way of example U.S. Pat. No. 8,127,575 discloses a fabric combination where moisture is required to be transported rapidly and comfortably from one side of the fabric to the other and then to be spread over a wide surface area to maximize the cooling effect due to evaporation. Such fabrics are then also faster drying than normal fabrics. However, while keeping the wearer drier, the moisture in the other side of the material, away from the skin, while less saturated, because of the wider area is still moist and may lead to moisture spreading to clothing with which it comes in contact.

Accordingly, a bra which overcomes the shortcomings of the prior art is desired.

SUMMARY OF THE INVENTION

A bra includes at least one cup. A sling is disposed adjacent the cup. The sling is disposed adjacent the cup in facing relation with a user of the bra. The sling includes a first layer deposed to be in contact with the skin of the user when the bra is worn; the first layer wicking moisture away from the skin of the user. A second layer of the wicking member is disposed on a surface of the first layer away from the skin contacting surface of the first layer. The second layer trapping moisture received from the first layer. A third layer is disposed on a surface of the second a layer which is away from the first layer and is a moisture barrier, preventing moisture from travelling therethrough.

In a preferred non limiting embodiment the wicking member is folded upon itself. The first layer forms an outer surface of the wicking member and the barrier member being folded upon itself forming an inner surface.

In another embodiment of the invention the third layer is disposed in facing relationship with the cup.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE INVENTION

Figure 1:
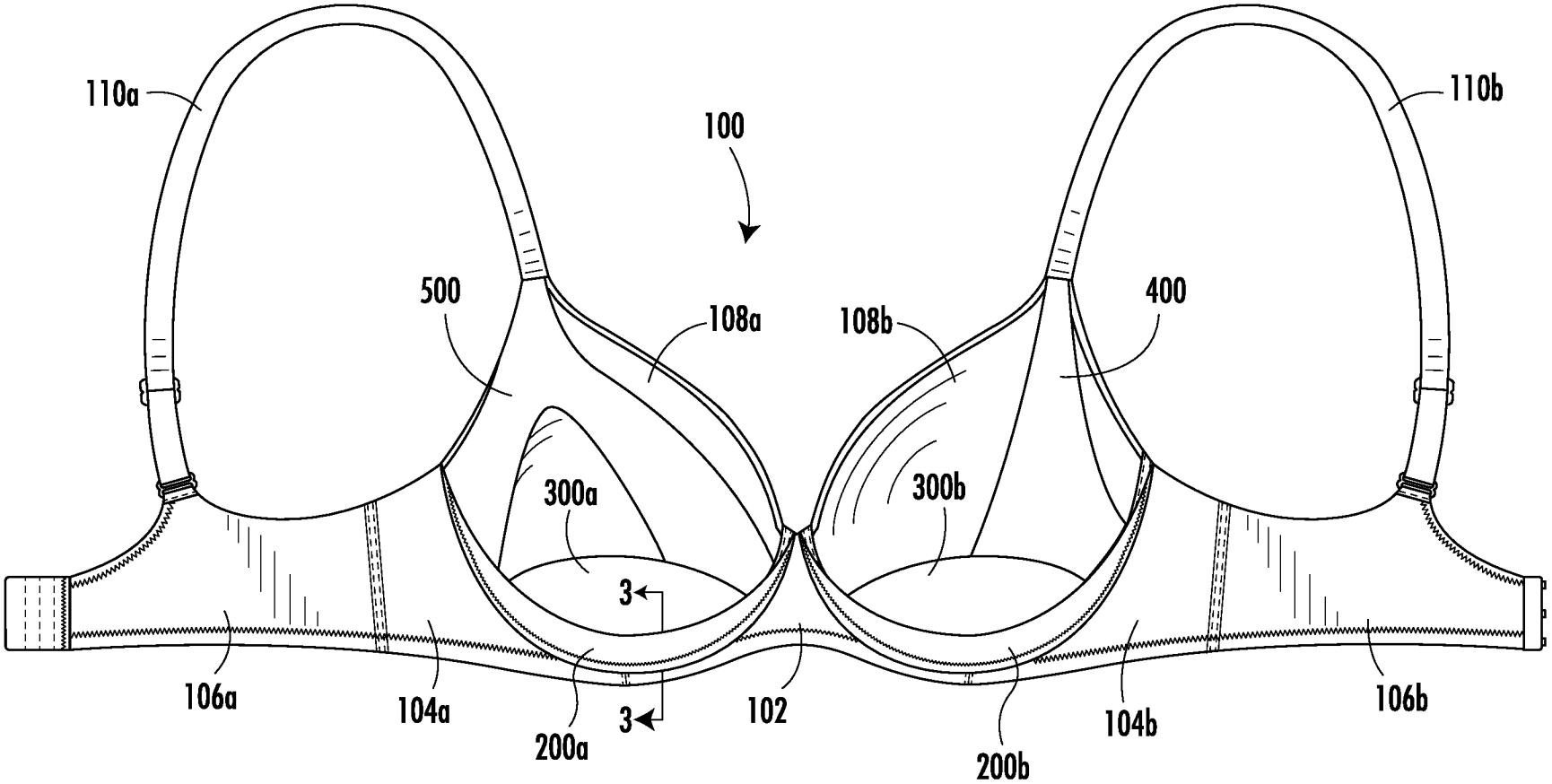
FIG. 1 is a rear elevation view of a bra constructed in accordance with the invention.
Figure 2:
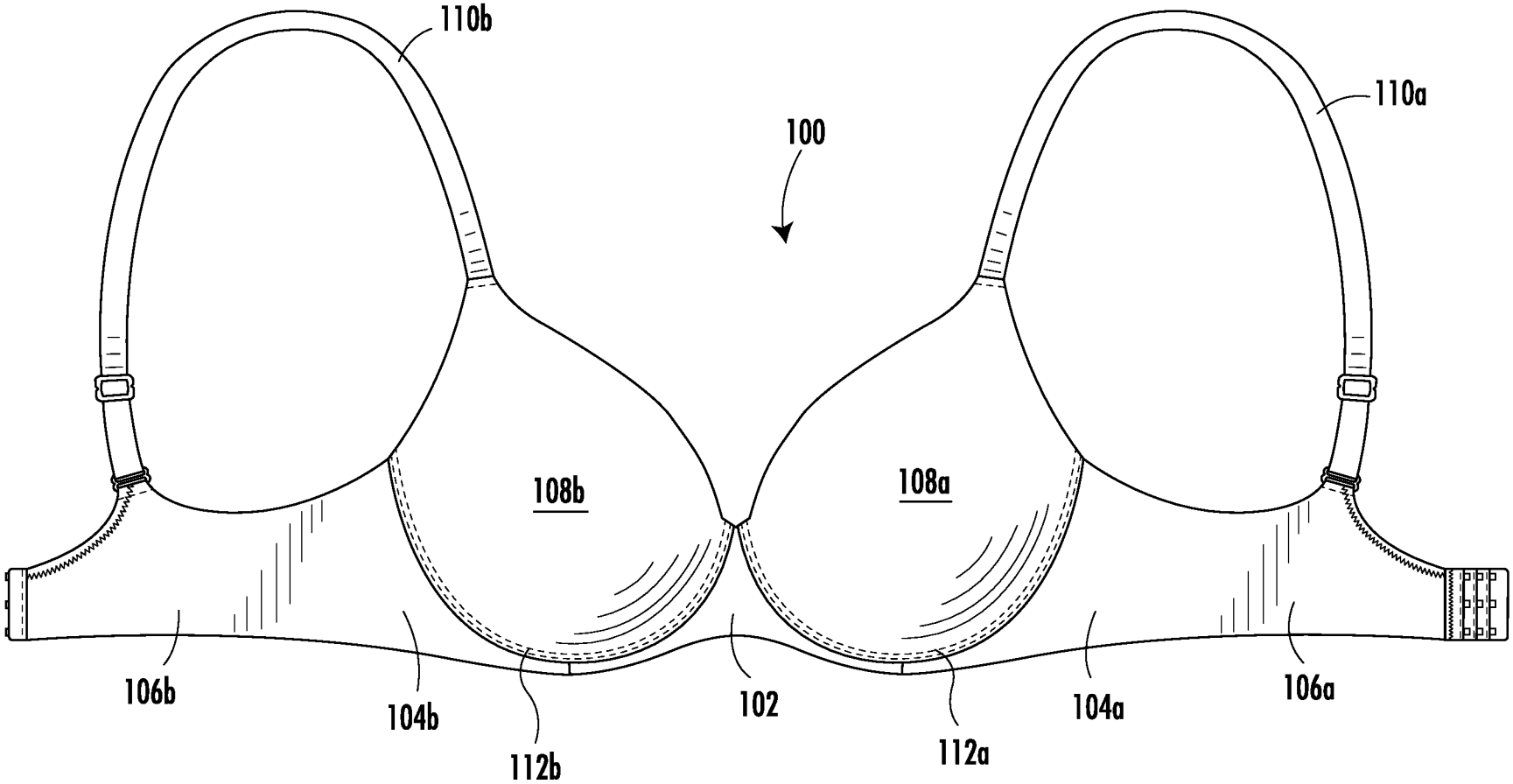
FIG. 2 is a front elevation view of a bra constructed in accordance with the invention.

Aspects and embodiments of the present invention will now be discussed with reference to the accompanying drawings. Further aspects and embodiments will be apparent to those skilled in the art. Reference is now made to FIGS. 1 and 2 in which a bra, generally indicated as 100, and constructed in accordance with the invention. Bra 100 includes two sides which are constructed as mirror images of each other.

Bra 100 includes a gore or center 102 which extends into respective cradles 104*a*, 104*b*. A wing 106*a* or 106*b* extends from a respective one of cradles 104*a*, 104*b*. A cup 108*a*, 108*b* for receiving and positioning a breast therein, is disposed between the center 102 and a respective cradle 104. In one alternative embodiment a strap 110*a* and 110*b* may extend from a respective wing 106 to a respective cup 108 to provide additional support to the wearer. However, it is well within the scope of the invention to provide the described bra without a strap 110.

As seen from FIG. 2, each cup 108*a*, 108*b* may be provided with an underwire 112*a*, 112*b* to provide support for and desired positioning for the breast in respective cup 108*a*, 108*b*. A respective sling 200*a*, 200*b* is provided adjacent cup 108*a*, 108*b*. In the prior art bras it is known to incorporate a sling that sits to the outer side cup or at the under part of the cup that is utilized to help shape or support the breast or to alleviate pressure from the wires of a bra. These slings functionally serve as part of the support structure of the bra or to provide a layer of cushioning comfort or and can be comprised of a variety of types and materials. Typically, this sling will be comprised of lightweight yet strong, single ply or single ply folded material such as a tricot denier or power mesh material that offers support, shape and projection or could be a single layer of foam that provides cushioning and comfort. Such a structure merely exacerbates the sweat issue.

Figure 3:
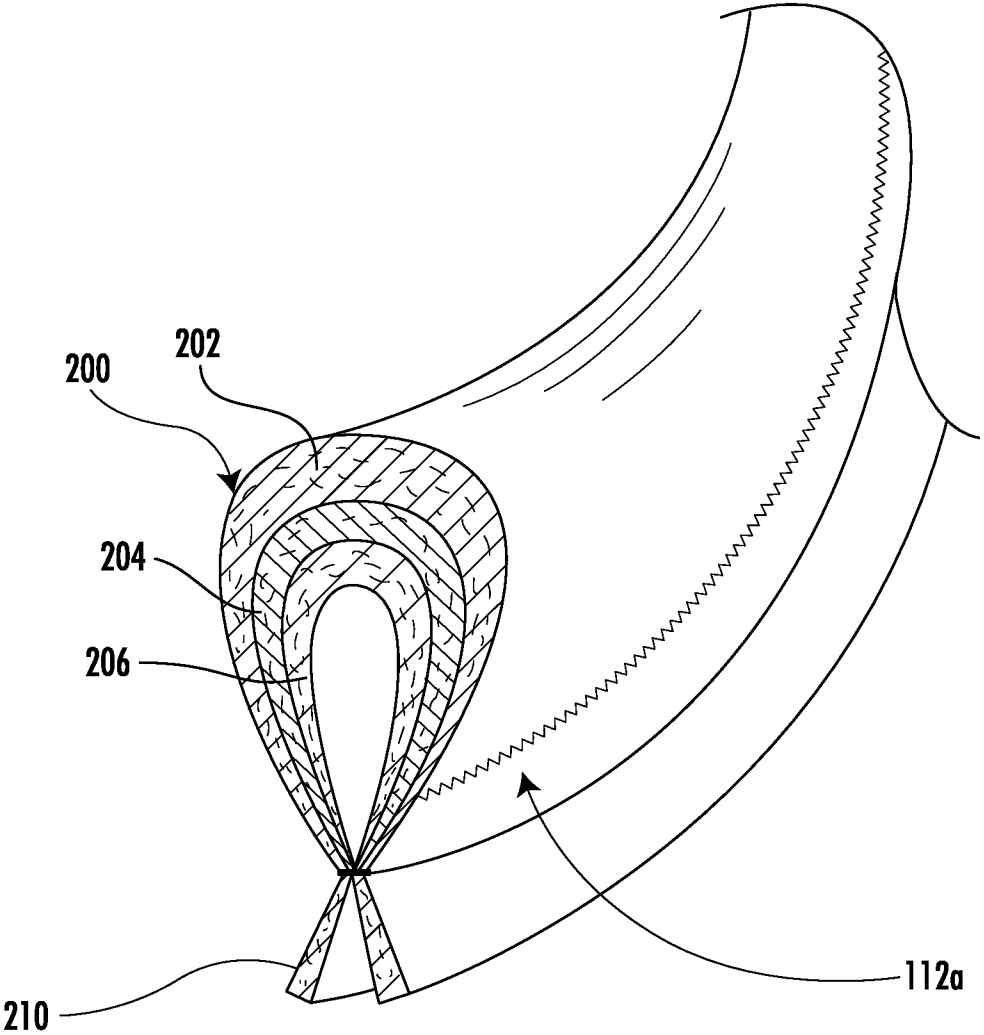
FIG. 3 is a sectional view taken along line 3-3 of FIG. 1.
Figure 4:
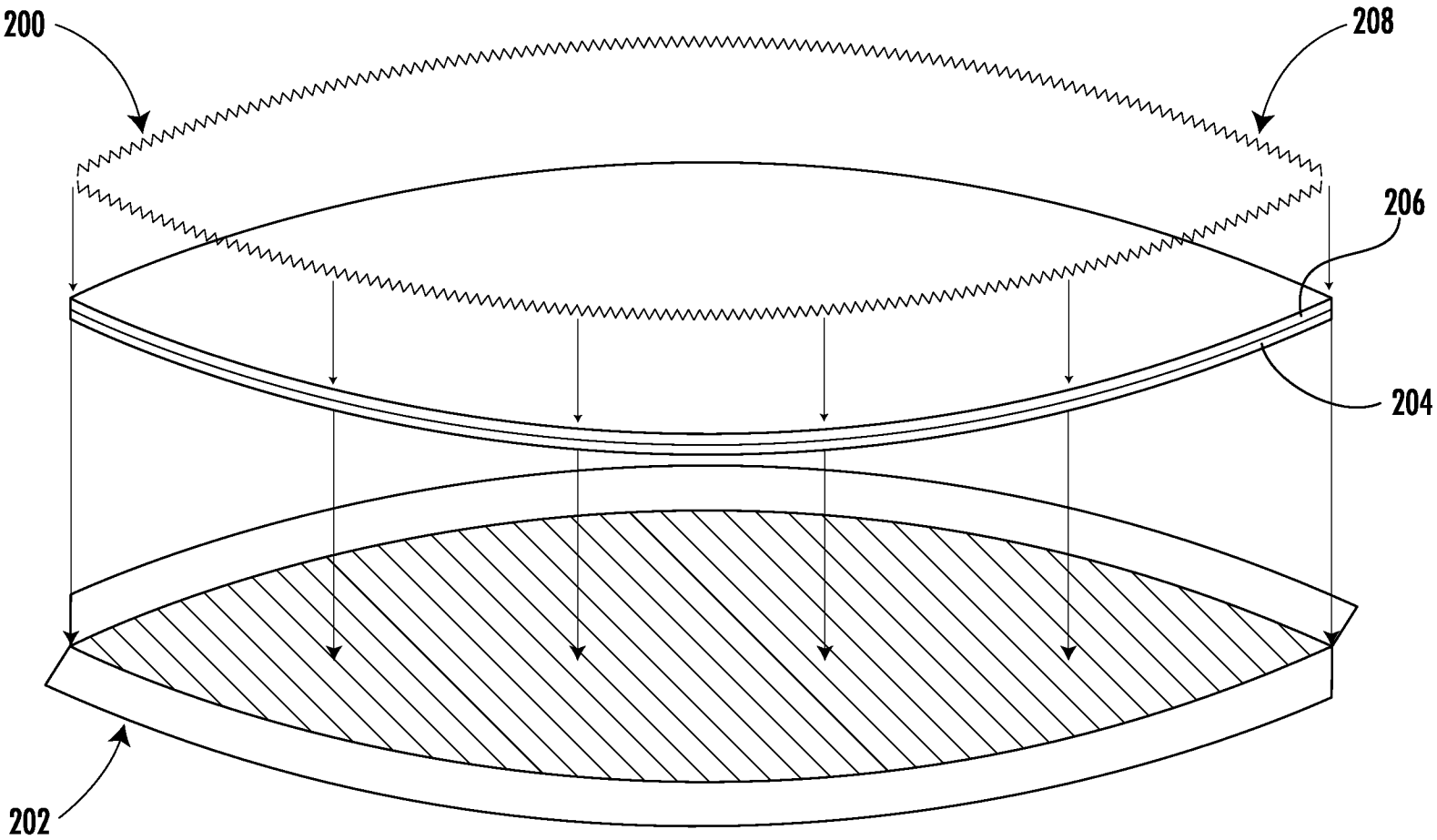
FIG. 4 is an exploded view of a sling constructed in accordance with the invention.

As seen in FIGS. 3 and 4 a sling 200, only one sling is described as the structure for each is the same, constructed in accordance with the invention alleviates the problem. Sling 200 has a multi-layer construction having a first wicking layer 202. Wicking layer 202, as will be described below is in facing relationship with the skin of the user and draws, or wicks, away the moisture from the skin. A second, trapping, layer 204 is disposed on a surface of wicking layer 202 which is not in contact with skin of the wearer; the opposed side thereof. Trapping layer 204 has wicking properties and draws moisture from wicking layer 202. Sling 200 includes a third, barrier membrane, layer 206 preventing moisture from passing therethrough. Barrier membrane 206 is disposed on a surface of trapping layer 204 away from wicking layer 202, the opposed side from layer 202. First layer 202, second layer 204 and third layer 206 are affixed to each other by a zigzag stitch 208.

When affixed to bra 100, sling 200 is folded upon itself so that wicking layer 202 is the only surface in facing relationship with the wearer. In this way, the entire surface of first layer 202, and in turn the entire outer surface of sling 200, is acting to wick away moisture which is then drawn to second layer 204, where it is trapped, held in place by the third, barrier, layer 206. It should be noted, as seen in FIG. 4, wicking layer 202 is wider than either of trapping layer 204 and barrier layer 208, so that when folded upon itself a skirt 210 is formed. As seen in FIG. 3, in a preferred non limiting embodiment, skirt 210 is affixed to cradle 104, adjacent cup 110, at wire the channel through which wire 112 passes.

It should be noted that in the non limiting preferred embodiment, three layers of material were used, however, more than three layers of material providing the function described above may be used. In a preferred embodiment the first layer, the wicking material is one of a Jacquard material, by way of non limiting example. The second, trapping, layer is made of terry cloth material by way of nonlimiting example. The third barrier layer is made of a plastic based material, in non-limiting preferred embodiment, and in a preferred embodiment is laminated to the trapping layer material.

As can be seen from the above, the sling mechanism is designed in a way that carefully utilizes multiple layers of uniquely combined materials that work together in harmony to first capture the moisture and transpose the water droplets to the reverse side of the fabric, transferring it to an absorption layer, away from the wearer of the garments skin, and then finally trapping the moisture in by using a waterproof membrane ensuring that the water does not exit the sling, or leak through the outward separate layers of clothing, keeping the wearer completely dry and free of the moisture returning to the body of the wearer.

While preferably in the form of sling 200, the sling may take on other forms as needed. By way of non limiting example, partial sling 300 disposed in a lower portion of a cup 110 may be disposed adjacent cup 108 in a portion of cup 108 extending from cradle 104 along a bottom portion of cup 108 extending a length no to exceed one half the height of cup 108 in this example so as to be below the breast of the wearer. Sling 300 is disposed adjacent cup 108, beneath the breast, with wicking layer 202 in facing relationship with the breast of the wearer and barrier layer 206 is in facing relationship with cup 108; i.e. sling 300 is not folded upon itself.

In yet another example a sling 400, disposed adjacent cup 108, may extend the height of cup 108, but not the width, but covers a sufficient breast area to wick moisture from the breast. Again, wicking layer 202 is in facing relationship with the breast of the wearer and barrier layer 206 is in facing relationship with cup 108; i.e. sling 400 is not folded upon itself.

In yet another embodiment, a sling 500 disposed adjacent cup 108, may extend the height of cup 108, but not the width, having the shape of a maternity "A" frame sling. but covers a sufficient breast area to wick moisture from the breast. Again, wicking layer 202 is in facing relationship with the breast of the wearer and barrier layer 206 is in facing relationship with cup 108; i.e. sling 500 is not folded upon itself. It should be noted that the cradles are designed to work alone or in collaboration with one or more of the other embodiments as a function of design choice.

The invention has been described with reference to a preferred embodiment. The description is intended to enable the skilled person to make the invention, not to limit the scope of the invention. The scope of the invention is determined by the claims.

The features disclosed in the foregoing description, or in the following claims, or in the accompanying examples and figures, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

While this invention has been particularly shown and described to reference the preferred embodiments thereof, it would be understood by those skilled in the art that various derivatives and changes in form and detail may be made therein without departing from the spirit and the scope of the invention, by the appended claims.

The invention claimed is:

1. A bra comprising:

at least a first cup; and a sling affixed to the first cup and disposed adjacent the first cup, at an underpart of the first cup, and configured to be in facing relation with a user of the bra; the sling comprising:

a first layer configured to be disposed in contact with skin of the user, the first layer configured to wick moisture from the skin of the user;

a second layer disposed on a surface of the first layer away from the surface in contact with the user, the second layer trapping moisture received from the first layer; and a third layer disposed on a surface of the second layer away from the first layer, the third layer being moisture resistant, preventing moisture from moving therethrough; and wherein the sling is folded upon itself and stitched to itself to maintain a folded and closed configuration; the first layer forming an outer surface of the sling configured to be in contact with the skin of the user of the bra, and the third layer being folded upon itself forming a closed inner surface of the sling.

2. The bra of claim 1, further comprising a cradle, wherein the sling is affixed along the cradle.

3. The bra of claim 1, wherein the sling covers a lower portion of the first cup.

4. The bra of claim 1, where in the second layer is laminated to the third layer.

* * * * *